US005245301A

United States Patent [19]

Portrait et al.

[11] Patent Number: 5,245,301

[45] Date of Patent: Sep. 14, 1993

[54] MOBILE MICROWAVE LINK USING WAVEGUIDES

[75] Inventors: Laurent Portrait, Houilles; Pierre Blanchard, Verrieres Le Buisson; Joël Soquet, Paris, all of France

[73] Assignee: Thomson-CSF, Puteaux, France

[21] Appl. No.: 878,860

[22] Filed: May 5, 1992

[30] Foreign Application Priority Data

May 14, 1991 [FR] France ..... 91 05805

[51] Int. Cl.[5] ..... H01P 1/06

[52] U.S. Cl. ..... 333/256; 333/257; 343/761

[58] Field of Search ..... 333/249, 256, 257, 254; 343/761, 763

[56] References Cited

U.S. PATENT DOCUMENTS

| | | | |
|---|---|---|---|
| 2,521,818 | 9/1950 | Aron et al. | 333/257 |
| 2,584,399 | 2/1952 | Preston | 333/257 |
| 2,708,263 | 5/1955 | Walters | 333/257 |
| 2,736,867 | 2/1956 | Montgomery . | |
| 3,517,341 | 6/1970 | Augustin . | |
| 4,283,727 | 8/1981 | Martel et al. | 333/257 X |
| 4,593,288 | 6/1986 | Fitzpatrick | 343/705 |
| 4,647,884 | 3/1987 | Lang et al. | 333/256 X |

FOREIGN PATENT DOCUMENTS

| | | | |
|---|---|---|---|
| 1032801 | 6/1958 | Fed. Rep. of Germany . | |
| 4002496 | 1/1991 | Fed. Rep. of Germany . | |
| 924779 | 4/1982 | U.S.S.R. | 333/257 |
| 1565971 | 4/1980 | United Kingdom . | |

*Primary Examiner*—Paul Gensler

*Attorney, Agent, or Firm*—Marmorek, Guttman & Rubenstein

[57] ABSTRACT

This microwave link connects a fixed set of electronic equipment to a mobile set of electronic equipment that can be shifted between two extreme positions, at least one of which is an operating position. The link is, for example, one between a radar transceiver and a radar antenna that can be retracted into a silo. It is constituted by a sequence of rigid rectangular waveguide elements hinged at their ends by means of hinges comprising at least one rotating connector formed by two rectangular-window flanges, fitted together and rotational movable with respect to each other. This rotational connector has two operational positions at 180° with respect to each other where it can transmit microwave power and where the rectangular windows of its flanges coincide, and it assumes one of these operational positions when the movable electronic equipment is in the operating position.

9 Claims, 8 Drawing Sheets

MOBILE MICROWAVE LINK USING WAVEGUIDES

BACKGROUND OF THE INVENTION

1. Field of the Invention

The present invention relates to a mobile microwave link between two sets of electronic equipment, one of which may be shifted or moved between two extreme positions, for example a microwave link between a radar transceiver and a radar antenna that can be retracted into a silo.

Microwave energy is normally conveyed by means of coaxial lines or waveguides that may or may not be pressurized. The latter may carry a great deal of power with a minimum of losses. Most of them are rigid tubes made of copper-based metal or of a light alloy. Others are flexible but, in this case, they remain delicate.

2. Description of the Prior Art

There is a known way of making a mobile microwave link by means of flexible coaxial cables, but the power transmitted is limited and there are substantial losses.

There is also a known way of making a mobile microwave link by means of a flexible rectangular waveguide, but the losses are very high and the reliability is limited.

It is also possible to use rigid waveguide elements connected to one another by flexible rectangular waveguides, but there are again substantial losses and, above all, the reliability is reduced when the movements are numerous.

SUMMARY OF THE INVENTION

The present invention is aimed at providing a mobile microwave link that is mechanically reliable, permits a large number of movements and can convey power with a minimum of losses in at least one of the extreme positions of movement.

An object of the invention is a mobile microwave link using waveguides, connecting a fixed set of electronic equipment to a mobile set of electronic equipment that can be shifted between two positions, one of which is an operating position. This microwave link has a succession of at least two rigid rectangular waveguide elements, hinged to each other at their ends by means of a rotating connector formed by two rectangular-window flanges that are fitted together and are rotationally movable with respect to each other. The rotating connector has two operational positions, at 180° with respect to each other, that correspond to a placing of the rectangular windows of its flanges in a state of coincidence, these being positions wherein said rotating connector can transmit microwave energy. It assumes one of these operational positions when the mobile set of electronic equipment is in the operating position.

According to a preferred embodiment, the succession of elements connects the mobile set of electronic equipment to a fixed point that is fixedly joined to the fixed set of electronic equipment and is positioned beside the path of the mobile set of electronic equipment, midway between the two limit positions of movement of this mobile set of electronic equipment and assumes a configuration, for each limit position of the mobile set of electronic equipment, wherein its rotating connectors are stopped in operational positions where the rectangular windows of their flanges coincide and enable a transmission of microwave energy.

BRIEF DESCRIPTION OF THE DRAWINGS

Other features and advantages of the invention shall emerge from the following description of an embodiment. This description is made here below with reference to the appended drawings, wherein.

The same elements have been given the same references in the different figures.

MORE DETAILED DESCRIPTION

A description is given here below of a dual mobile microwave link with two waveguides used, in a monopulse system, to connect the sum and difference channels of a radar antenna retractable into a silo with radar transmission and reception sets placed in rooms adjoining the silo.

Figure 1:
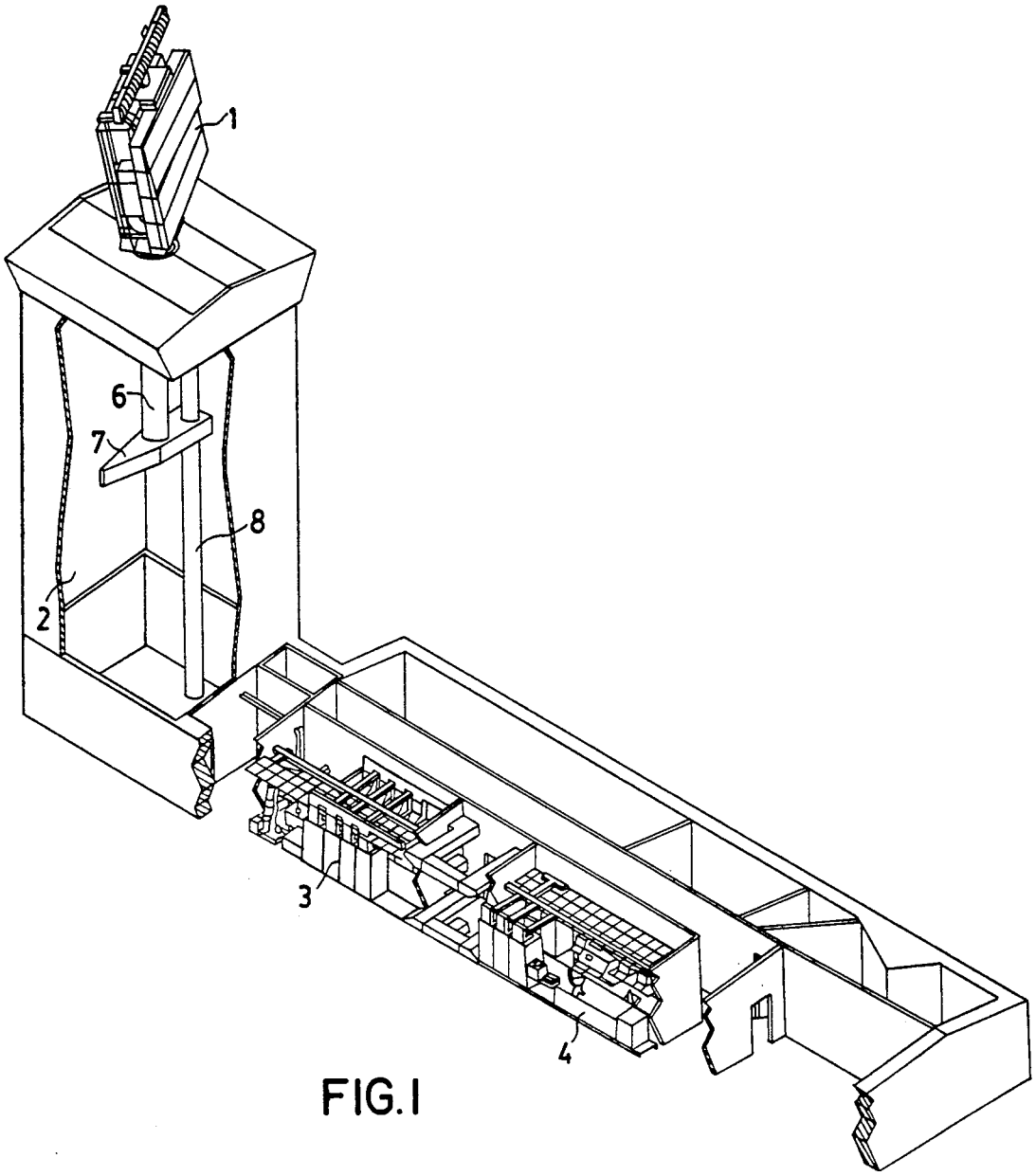
FIG. 1 is a cutaway view in perspective of a radar installation with its antenna raised above a silo and its transmission and reception sets placed in rooms adjoining the base of the silo.

FIG. 1 shows the radar installation with its antenna 1 raised above a silo 2 and its transmission set 3 and receiving set 4 placed in rooms adjoining the base of the silo 2.

Figure 2:
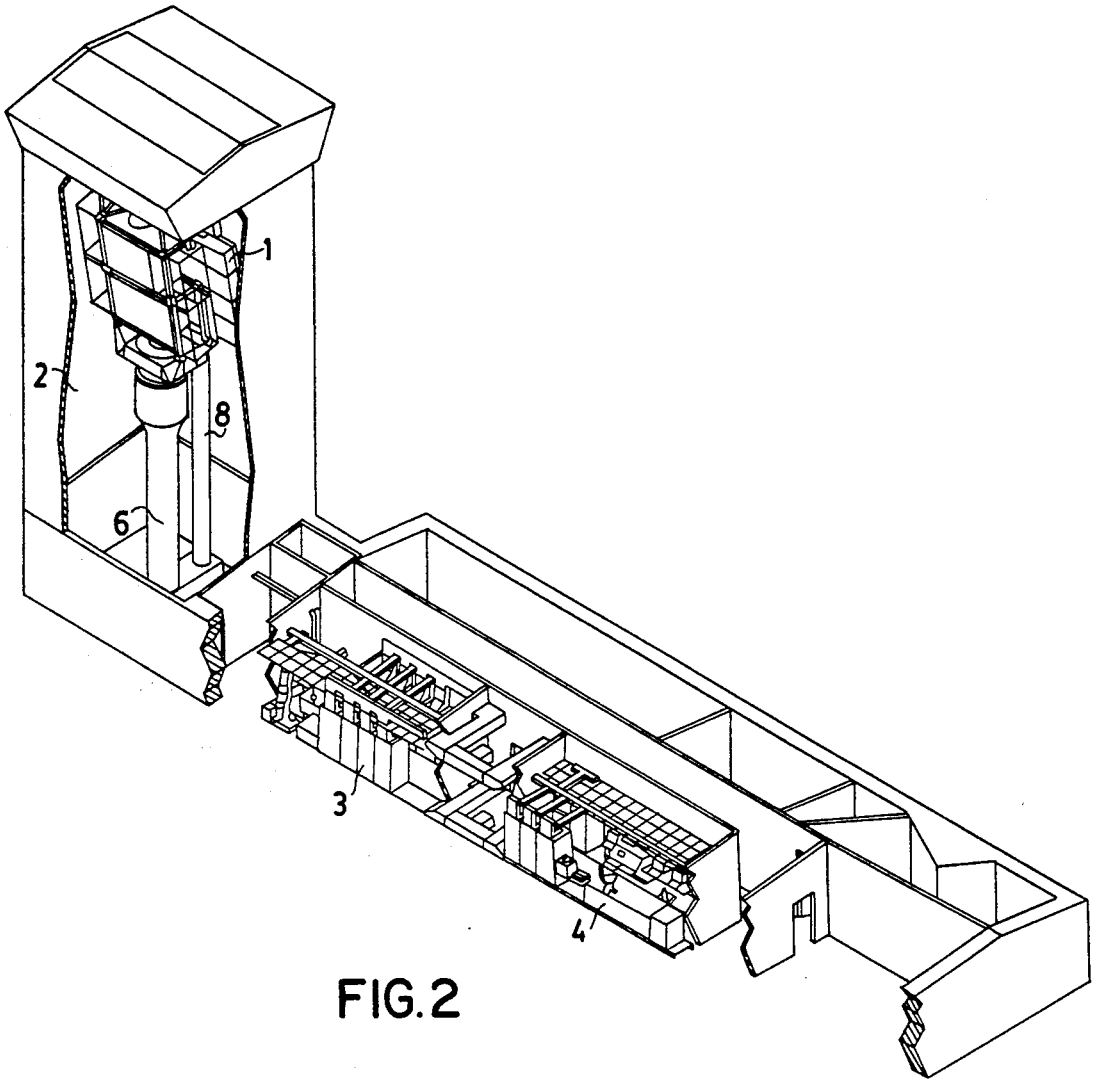
FIG. 2 shows an cutaway view in perspective of the above radar installation with its antenna retracted into the silo.

FIG. 2 shows the same radar installation with its radar 1 withdrawn into the silo.

The microwave connection of the antenna 1 to the transmission set 3 and the reception set 4 of the radar should enable the movements of the antenna 1 in its silo 2 and its operation when it is raised outside this silo. It is made by means of a mobile microwave link that joins the base of a mast 6 supporting the antenna 1 on an elevator platform 7 at a fixed point located at mid-height on the wall of the silo 2 which is the ending point of fixed rectangular waveguides coming from the transmission set 3 and reception set 4 of the radar.

Figure 3:
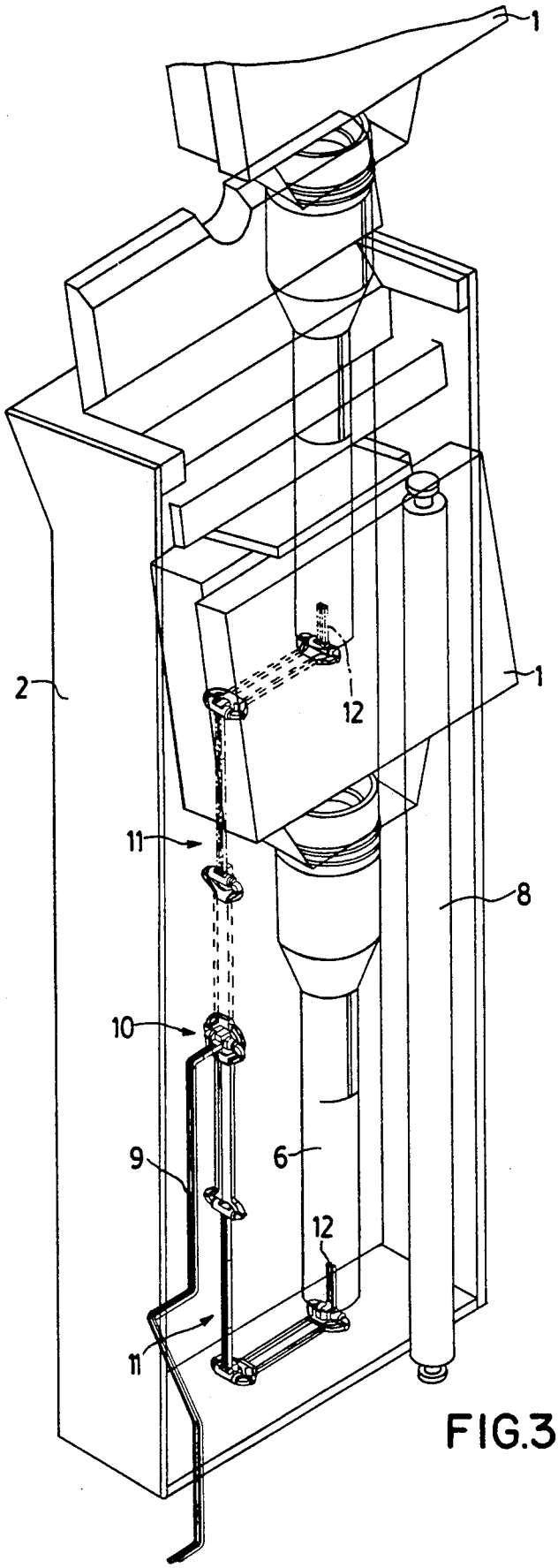
FIG. 3 shows a partial view in perspective illustrating the interior of the silo of the radar installation seen in FIGS. 1 and 2.

This microwave link is shown in its two extreme positions, respectively in solid lines and in dashed lines under the reference 11, in FIG. 3 which shows the interior of the silo 2 with the antenna 1 mounted on its mast 6 shown both in its raised position and in its withdrawn position. For greater clarity, the elevator platform 7 which supports the mast 6 of the antenna 1 and shifts along a pillar 8 containing an elevator mechanism has not been shown.

This mobile microwave link 11 connects the ends of the rectangular waveguides 12, which are fixedly joined to the base of the mast 6 of the antenna 1, to the ends of fixed rectangular waveguides 9 coming from the transmission and reception sets and ending at a fixed point 10 located at mid-height on the wall of the silo 2. It is formed, as can be seen more clearly in FIG. 4, by a succession of three rigid rectangular waveguide elements 13, 14, 15 hinged to each other as well as to the rectangular waveguides 9 and 12 by means of four hinges 16, 17, 18, 19. The rigid elements 13, 14, 15 are each constituted by an assembly of two parallel sections of rectangular waveguides dedicated to the simultaneous transmission of the sum and difference channels of a monopulse system. The hinges 16, 17, 18, 19 are constituted by two rotating connectors providing for the continuity of each of the two rectangular waveguides of the rigid elements 13, 14, 15.

Figure 5:
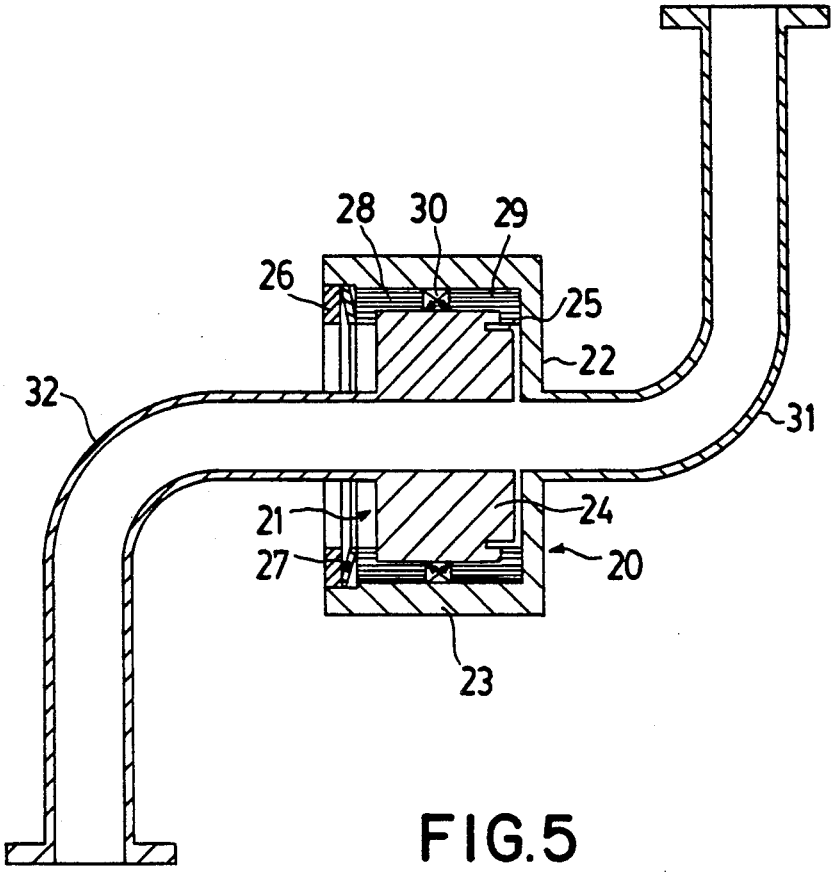
FIG. 5 shows a longitudinal sectional view of a simple rotating connector used in the mobile microwave link shown in FIGS. 3 and 4.

FIG. 5 shows a longitudinal section of a simple rotational connector acting as a hinge for the rigid elements of the succession of elements, for a sum or difference channel. This rotational connector for rectangular waveguides comprises two flanges with rectangular windows, one flat flange 20 and one choke flange 21, both flanges being fitted into each other and being rotationally mobile with respect to each other. The flat flange 20 has, around its rectangular window, a circular plate 22 that extends externally by a ring 23 giving the end of the flat flange 20 the shape of a bush. The choke flange 21 has a cylindrical core 24 around its rectangular window which cylindrical core 24 matches the internal dimensions of the ring 23. The cylindrical core 24 is fitted into the bush formed by the end of the flat flange 20. A peripheral groove 25 constitutes a quarter-wave trap.

The hole of the ring 23 of the flat flange is provided with an internal thread enabling the screwing in of a bolt 26 that imprisons the cylindrical core 24 of the choke flange 21 in the bush of the flat flange 20. An elastic washer 27 interposed between the nut 26 and the cylindrical core 24 of the choke flange 21 enables this choke flange 21 to be placed flat against the circular plate 22 of the flat flange 20. Friction elements 28, 29, inserted in the bush of the flat flange 20, at the periphery of the cylindrical core 24 of the choke flange 21, enable both the centering and the frictional rotation of the two flanges 20 and 21 with respect to each other. A median seal 30 provides for impervious sealing, should the internal volume of the flanges 20 and 21 and of the rectangular waveguides attached to them be pressurized in order to enable the conveyance of a maximum of microwave energy.

Each flange 20 or 21 is extended by a portion of a rectangular waveguide provided with an elbow 31, 32, curved at 90° in one of the planes of the large or small width of the rectangular waveguide so that the rotation between the flanges 20, 21 of a rotating connector is expressed, for the rigid rectangular waveguide elements which are connected to it, by a pivoting motion with a transversal axis.

The rotating connection just described may transmit microwave energy when the rectangular windows of its flanges coincide. This takes place for two positions, known as operational positions, which are at 180° with respect to each other and correspond, for rigid elements hinged by the rotating connector, to precise relative positions which depend on the planes of curvature of the elbows.

Figure 7:
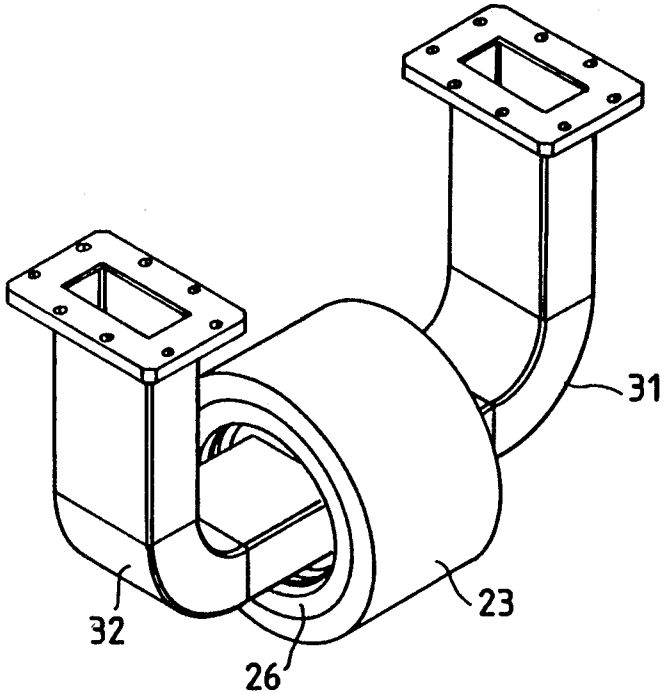
FIGS. 6 and 7 show views in perspective of the rotating connector of FIG. 5 in its two operational positions where it can transmit microwave energy.
Figure 6:
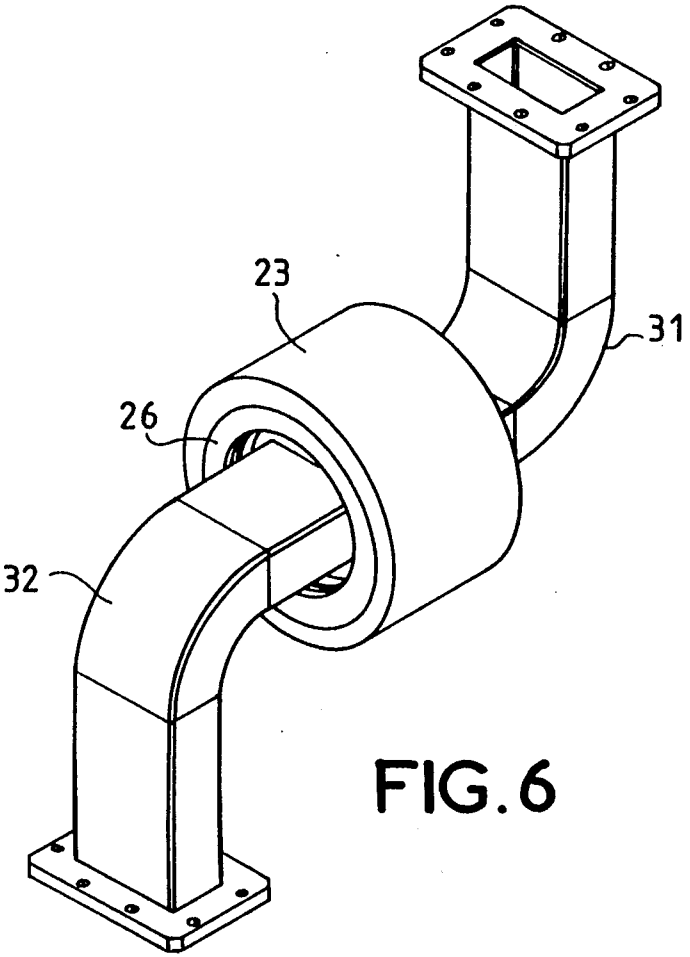

FIGS. 6 and 7 show a view, in perspective, in two operational positions, of a rotating connector with its elbows curved at 90° in a plane parallel to the smallest width of the rectangular waveguide. In the first operational position of FIG. 6, where the rectangular windows of the flat and choke flanges coincide, the two elbows 31 and 32 oriented in a same plane prompt an aligning, in extension, of the two rigid waveguide elements hinged by the rotating connector. In the second operational position of FIG. 7, where the rectangular windows of the flat and choke flanges also coincide, the two elbows 31 and 32 oriented in a same plane cause an aligning, in a side-by-side folded position, of the two rigid waveguide elements hinged by the rotating connector.

The two elbows of a rotating connector may also be curved at 90° in a plane parallel to the big width of the rectangular waveguide. As above, for the two operational positions of the rotating connector, they prompt an aligning, in extension or in the folded position, of the two rigid waveguide elements hinged by the rotating connector.

Figure 6A:
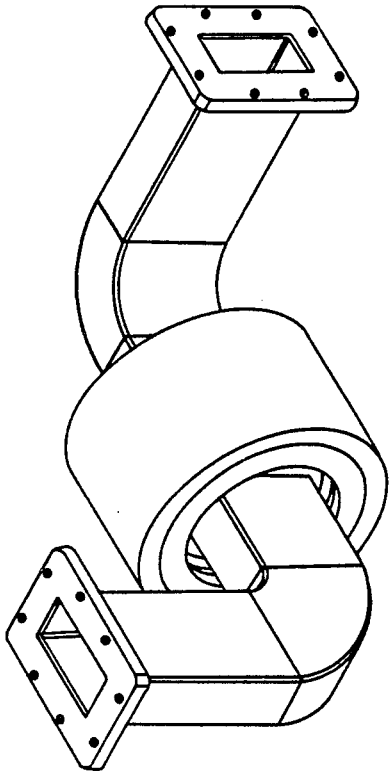
FIGS. 6*a* and 7*a* show perspective views of alternative rotating connectors having one elbow that is curved in a plane parallel to the big width of a rectangular waveguide to which it is connected and one elbow that is curved in a plane parallel to the small width of another rectangular waveguide to which it is connected.
Figure 7A:
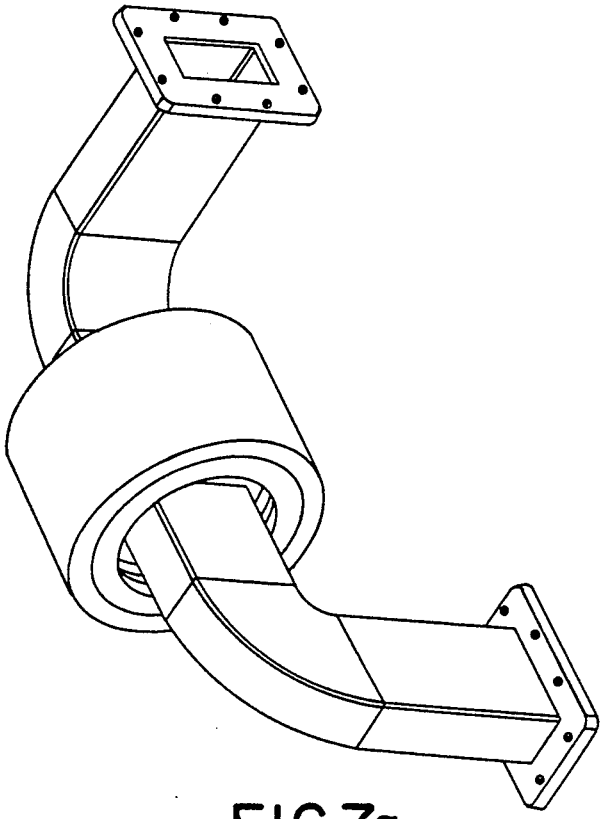

The two elbows of a rotating connector may also be curved at 90°, one in a plane parallel to the small width of the rectangular waveguide and the other in a plane parallel to the large width of the rectangular waveguide, as shown in FIGS. 6*a* and 7*a*. Then, for the two operational positions of the rotating connector, they prompt a positioning at right angles, either in one direction or in the other, of the two rectangular waveguide elements hinged by the rotating connector.

Figure 4:
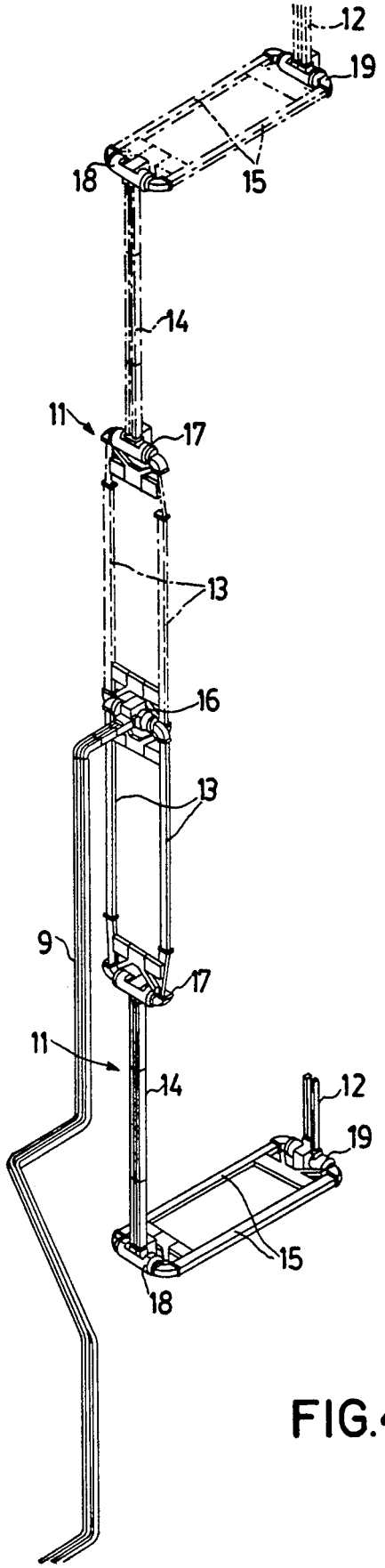
FIG. 4 shows a view in perspective of the mobile microwave link fitted into the radar installation seen in the above figures.

The succession of three hinged rigid elements 13, 14, 15 described here above with reference to FIG. 4 assumes an L-shaped configuration or a -shaped configuration when the antenna is in the extreme retracted or raised position, its rigid elements 13, 14, 15 coming, two by two, into alignment or into a right-angled position with, at each time, rotating connectors in operational positions to enable the exchange, in these positions, of microwave energy between the antenna and the transmission and reception sets. The end hinges 16, 19 of the succession of rigid elements as well as the hinge 18 that attaches elements placed at right angles when the antenna is in the extreme retracted or raised position are each formed by two rotating connectors having a same transversal axis of the type with elbows curved at 90° in two orthogonal planes, one parallel to the small width and the other parallel to the large width of the rectangular waveguide. The hinge 17 of the succession of elements, that attaches elements placed in alignment when the antenna is in the extreme retracted or raised position, is formed by two rotating connectors with a same transversal axis of the type with elbows curved at 90° in the same plane parallel either to the large width or to the small width of the rectangular waveguide.

To maintain the L-shaped or -shaped configuration when the antenna is in the extreme retracted or raised position, the hinge 17 which attaches the rigid elements 13, 14 is provided with a mechanical retraction spring system tending to keep the rigid elements 13 and 14 aligned and the end hinge 19 is provided with a motor tending to reposition the rigid element 15 at right angles with respect to the rigid element 14 when the antenna is raised in an operational position outside its silo.

Figure 8:
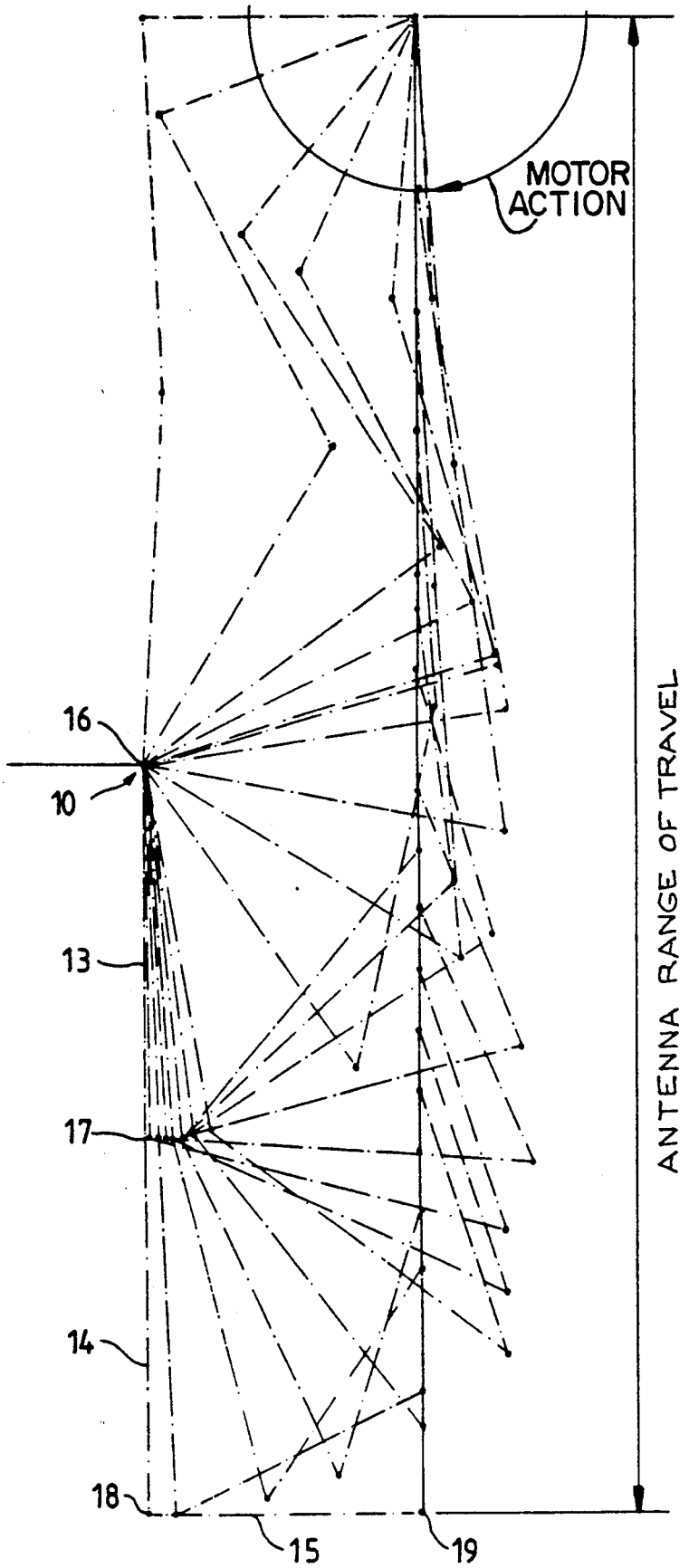
FIG. 8 illustrates the deformations undergone by the mobile microwave link shown in FIGS. 3 and 4 when the antenna goes from its retracted position to its position of being raised out of the silo.

FIG. 8 illustrates the deformations undergone by the succession of elements constituting the movable microwave link when the antenna goes from an extreme retracted position to an extreme raised position and vice versa.

When the antenna is retracted into its silo, the succession of elements forming the movable microwave link has an L-shaped configuration with its rotating connectors in operational positions enabling an exchange of microwave energy between the antenna and the transmission and reception sets for maintenance operations. The rigid element 13 hinged to the fixed point 10 hangs vertically as does the rigid element 14 which, for its part, is hinged by the hinge 17 provided with the mechanical drawback spring system. The rigid element 15 hinged to the base of the antenna mast and to the rigid element 14 is, for its part, placed horizontally at right angles with respect to the rigid element 14 and to the rectangular waveguides 12 fixedly joined to the base of the antenna mast.

When the antenna is raised out of the silo, the hinge 19 motor is disengaged, enabling the rigid element 15 to take various inclined positions dictated by the traction of the antenna and the effect of gravity on the three rigid elements 13, 14, 15 of the succession of elements. During this motion, the rigid element 14 is tilted and passes through the horizontal before being partly turned over while the rigid element 13 is tilted up to a position close to the horizontal.

Once the antenna is in its final position out of the silo, the hinge 19 motor is activated to make the rigid element 15 rise again to the horizontal and make the rigid elements 13 and 14 take a vertical position so as to obtain a -shaped position where all the rotating connectors of the hinges are again in operational positions, enabling the exchange of microwave energy between the antenna and the transmission and reception sets.

What is claimed is:

1. A mobile microwave link using waveguides, permanently connecting a fixed set of electronic equipment to a mobile set of electronic equipment that can be shifted between an operating position and a retracted position, wherein said microwave link comprises a succession of at least two rigid rectangular waveguide elements hinged to each other, at their ends, by a rotating connector comprising two rectangular window flanges that are fitted together with said rectangular windows disposed on opposite sides of, and centered with respect to, a pivoting axis of rotation of said rotating connector, said rectangular window flanges being rotationally movable with respect to each other about said axis, said rotating connector having two operational positions, at 180° with respect to each other, that correspond to a rotation of said rectangular windows of said flanges about said axis to a state of coincidence, wherein said rotating connector assumes one of these operational positions when the mobile set of electronic equipment is in the operating position and the other of said operational positions when said mobile set is in the retracted position.

2. A microwave link according to claim 1, wherein said rotating connector is formed by two rectangular-window flanges that are fitted together and are rotationally movable with respect to each other, one of said flanges being a choke flange and the other being a flat flange.

3. A microwave link according to claim 1, wherein said rotating connector further comprises at least one elbow that offsets said pivoting axis transversally with respect to the longitudinal axis of one of the rigid rectangular waveguide elements to which it is fixed.

4. A microwave link according to claim 3, wherein said rotating connector comprises, on each side of its flanges that are fitted together and rotationally movable with respect to each other, an elbow that offsets said pivoting axis transversally with respect to the longitudinal axes of the rigid rectangular waveguide elements to which it is fixed.

5. A microwave link according to claim 4, wherein said rotating connector comprises, on each side of its flanges that are fitted together and rotationally movable with respect to each other, an elbow at 90° curved in a plane parallel to the large width of the rectangular waveguide of the rigid element to which it is fixed, said rotating connector having operational positions that correspond to an aligning, in extended or in folded position, of the two rigid elements that bear it.

6. A microwave link according to claim 4, wherein said rotating connector comprises, on each side of its flanges that are fitted together and rotationally movable with respect to each other, an elbow at 90° curved in a plane parallel to the small width of the rectangular waveguide of the rigid element to which it is fixed, said rotating connector having operational positions that correspond to an aligning, in extended or in folded position, of the two rigid elements that bear it.

7. A microwave link according to claim 4, wherein said rotating connector comprises, on one side of its flanges that are fitted together and rotationally movable with respect to each other, an elbow at 90° curved in a plane parallel to the large width of the rectangular waveguide of the rigid element to which it is fixed and, one the other side of its flanges, an elbow at 90° curved in a plane parallel to the small width of the rectangular waveguide of the rigid element to which it is fixed, said rotating connector having operational positions that correspond to a positioning, at right angles, of the two rigid elements that bear it.

8. A microwave link according to claim 1, wherein said succession of rigid rectangular waveguide elements, hinged at their ends by means of rotating connectors formed by rectangular-window flanges that are fitted together and are rotationally movable with respect to each other, connects the mobile set of electronic equipment to a fixed point that is fixedly joined to the fixed set of electronic equipment and is positioned aside, midway between the two limit positions of movement of this mobile set of electronic equipment and assumes a configuration, for each limit position of the mobile set of electronic equipment, wherein its rotating connectors are stopped in operational positions where the rectangular windows of their flanges coincide.

9. A microwave link according to claim 8, wherein said succession comprises three rigid rectangular waveguide elements hinged at their ends by means of four hinges with rotating connectors provided with rectangular-window flanges that are fitted together and are rotationally movable with respect to each other, and on each side of the flanges, elbows at 90° that are curved in a plane parallel to either cross-sectional width of the rectangular waveguide and make said pivoting axis of the hinges transversal with respect to the longitudinal axes of the elements in giving one of them operational positions that correspond to the aligning of the rigid elements that it connects and in giving the other three hinges operational positions corresponding to the placing of the elements that they connect at right angles.

* * * * *